US006537186B1

(12) United States Patent
Veluz

(10) Patent No.: US 6,537,186 B1
(45) Date of Patent: Mar. 25, 2003

(54) PROCESS AND APPARATUS FOR HIGH-SPEED FILLING OF COMPOSITE CIGARETTE FILTERS

(75) Inventor: Serge Veluz, Cuarnens (CH)

(73) Assignee: Baumgartner Papiers S.A., Crissier (CH)

( * ) Notice: Subject to any disclaimer, the term of this patent is extended or adjusted under 35 U.S.C. 154(b) by 0 days.

(21) Appl. No.: 09/613,047

(22) Filed: Jul. 5, 2000

(51) Int. Cl.[7] ..... B31C 1/00

(52) U.S. Cl. ..... 493/42; 493/45; 493/47; 493/50

(58) Field of Search ..... 493/39, 42, 45, 493/47, 50

(56) References Cited

U.S. PATENT DOCUMENTS

| | | | | |
|---|---|---|---|---|
| 3,312,152 A | | 4/1967 | Williamson | |
| 4,015,514 A | | 4/1977 | Nichols | |
| 4,063,494 A | | 12/1977 | Hall | |
| 4,223,597 A | * | 9/1980 | Lebet | 493/45 |
| 4,225,597 A | | 9/1980 | Finckenor | |
| 4,285,677 A | * | 8/1981 | Ito et al. | 493/43 |
| 4,285,678 A | * | 8/1981 | Molins | 493/48 |
| 4,294,265 A | | 10/1981 | Kassman et al. | |
| 4,411,640 A | | 10/1983 | Hall | |
| 5,012,829 A | * | 5/1991 | Thesing et al. | 131/344 |
| 5,322,495 A | | 6/1994 | Budjinski, II et al. | |
| 5,360,021 A | | 11/1994 | Belvederi et al. | |
| 5,845,648 A | | 12/1998 | Martin | |
| 5,908,030 A | | 6/1999 | Coi et al. | |

* cited by examiner

*Primary Examiner*—Scott A. Smith
*Assistant Examiner*—Chukwurah Nathaniel
(74) *Attorney, Agent, or Firm*—Bugnion S.A.; John Moetteli

(57) ABSTRACT

A process of manufacturing composite filter stock is provided that includes several steps. In a first step, a paper carrier strip feeds along a conveyor. Along one edge of the carrier strip, the paper is folded back against itself. Fibrous filter segments are then deposited on the carrying strip in spaced apart intervals. The spacing defines cavities between adjacent filter segments. The carrier strip with the deposited filter segments is fed along a path of travel into an elongated guide or support chamber that substantially surrounds the circumference of the paper-enveloped segments and which leaves a narrow fill opening opposite an elongated particulate filling opening that is elongated in the direction of motion of the carrying strip. Suction or a vacuum is concurrently applied adjacent the narrow opening, the suction increasing a downward momentum of a gravity feed stream of particulate matter and concurrently vacuums away loose particulate matter. The cavities are concurrently filled with the particulate matter over a length corresponding to a predetermined path of travel of the carrying strip. The folded over edge is then unfolded and adhered to seal the fill opening. The filter stock is then cut to length, the cutting being registered to create discrete composite filter segments.

9 Claims, 7 Drawing Sheets

PROCESS AND APPARATUS FOR HIGH-SPEED FILLING OF COMPOSITE CIGARETTE FILTERS

BACKGROUND OF THE INVENTION

This invention relates to a process and apparatus for use in the manufacturing of cigarette filters. More particularly, this invention relates to a process and an apparatus for high-speed filling of particulate matter in discrete cavities defined by adjacent individual filter plugs during the filter assembly operation.

In composite filters having cavities filled with particulate matter, the fill percentage of the cavities is very important. This is because, as the cigarette is placed into the mouth, it lies in a substantially horizontal plane. Thus, gravity draws the particulate matter down away from the top of the cavity. This creates an unprotected, unfiltered bypass above the particulate matter that does not inhibit the flow of smoke. The affect that this bypass has on the filtering capacity of a filter is not yet appreciated but can possibly be disproportionately large compared to the linear proportion of the width of the bypass to the width of the filter element. In fact, fluid flow principals dictate that fluid prefers to flow along a path of least resistance, thus indicating that the filtering efficiency of the particulate matter may be greatly reduced by the presence of any such pass through portion.

Referring to U.S. Pat. No 3,312,152 to Williamson, the content of which is incorporated herein by reference, an apparatus is described which attempts to fill the filter cavities. The Williamson apparatus transfers particulate material into discrete spaces between filter plugs. However, the speed of operation of the apparatus is limited due to inefficiency of relying on gravity alone to fill the rapidly passing cavities.

A prior art machine such as that described in U.S. Pat. Nos. 4,063,494 and 5,908,030, the contents of which are incorporated by reference, includes gravity-fed, wheel-shaped receiving magazines that receive filter segments laid out adjacent to one another in a spaced apart relationship on a paper carrier strip. The loaded strip is then brought into an assembly or guide channel and toward a filling area where the paper is formed on wheels into a receiving trough. As described in U.S. Pat. No. 4,015,514 to Nichols, the content of which is incorporated by reference, a vacuum is applied across adjacent filter segments in an effort to promote the filling of the cavity. However, because both the spacing of the segments varies and the density of the cellulose acetate filters varies, it is impossible to fill the cavities with any consistency. This means that in order to ensure a minimum percentage of filling, the process must be set up to significantly overfill the cavities above this target level. The industry has compensated for this by not demanding a high fill percentage. In this manner, the process tolerates a very high variance provided that the target fill percentage is sufficiently high.

Further, despite the fact that the fill percentage demanded by industry is low, it is desirable to completely fill the cavity with granules. As explained above, this is because it has been shown that a cavity that is not completely filled allows smoke to bypass the particulate filling, thus failing to permit the particulate to remove the undesirable compounds in the smoke.

Further, overfill of the cavity or the escape of the particulate from the cavities may cause the particulate to adhere to the outer garniture or the paper carrier strip and thus become embedded near the surface of the final product, leaving an unsightly stain or mark.

What is needed is a process of completely filling filter cavities in a commercially practicable manner. More specifically, what is needed is a process and an apparatus to rapidly fill active charcoal filter cavities at a rate exceeding 200 m/min.

SUMMARY OF THE INVENTION

A process of manufacturing composite filter stock is provided that includes several steps. In a first step, a paper carrier strip or garniture feeds along a conveyor. Along one edge of the carrier strip, the paper is folded back against itself. Fibrous filter segments are then deposited on the carrying strip in spaced apart intervals. The spacing defines cavities between adjacent filter segments. The carrier strip with the deposited filter segments is fed along a path of travel into an elongated guide or support chamber that substantially surrounds the circumference of the paper-enveloped segments and which leaves a narrow fill opening opposite a particulate filling opening that is elongated in the direction of motion of the carrying strip. Suction or a vacuum is concurrently applied adjacent the narrow opening, the suction increasing a downward momentum of a gravity feed stream of particulate matter and concurrently vacuuming away loose particulate matter. The cavities are concurrently filled with the particulate matter over a length corresponding to a predetermined path of travel of the carrying strip. The folded over edge is then unfolded and adhered to seal the fill opening. Alternately, a sealing strip seals the opening, thus encapsulating the filter segments and particulate matter. The filter stock is then cut to length, the cutting being registered to create discrete composite filter segments.

In another feature, filter cavities may be rapidly and completely filled with particulate matter such as charcoal.

In another feature, the density of activated charcoal is controlled through the introduction of an inactive filler material.

DETAILED DESCRIPTION OF THE PREFERRED EMBODIMENT

Figure 1:
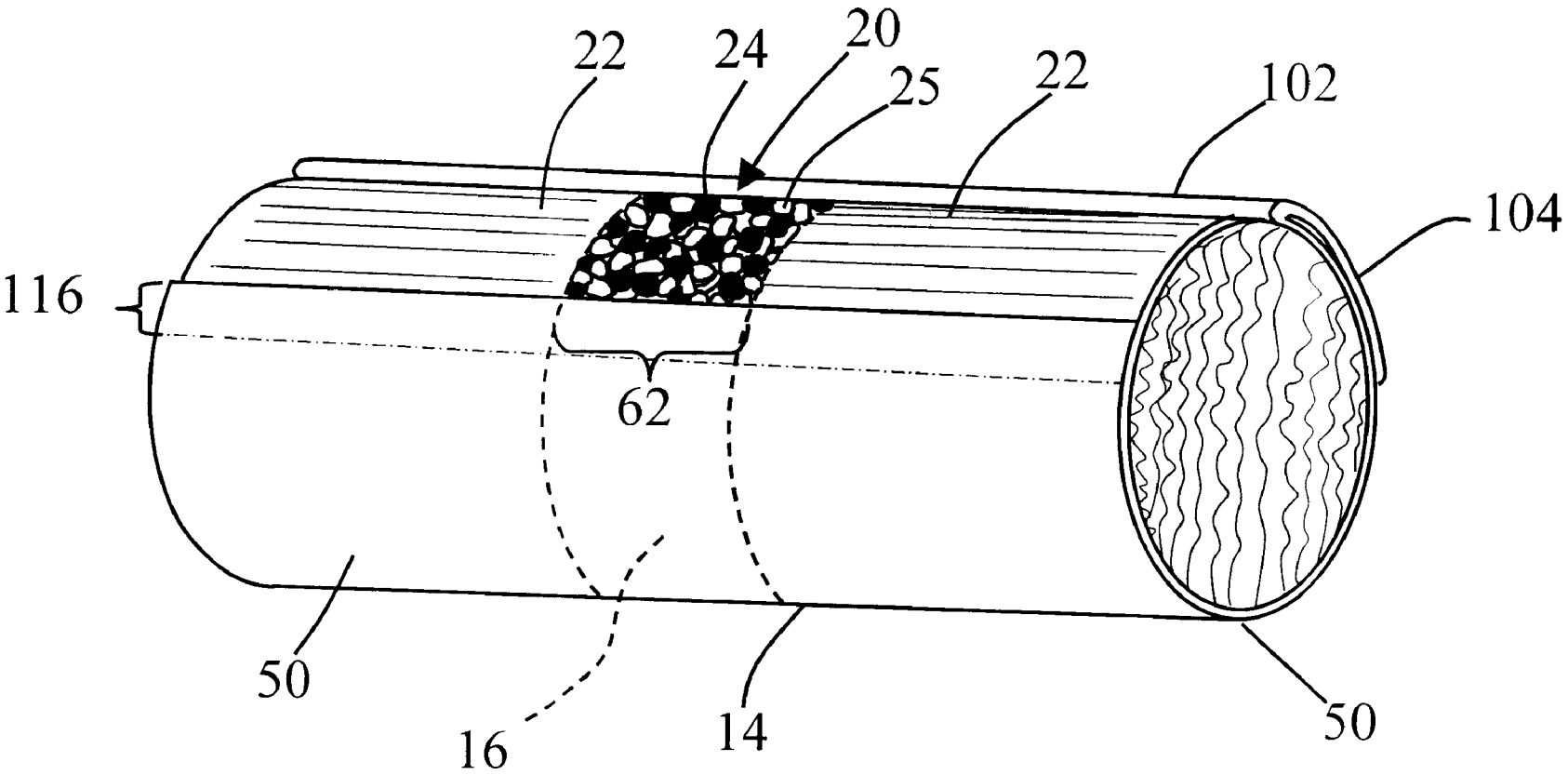
FIG. 1 is a perspective view of a partially assembled filter segment of the invention.

An apparatus 10 and a process 12 of manufacturing composite filter stock 14 having cavities 16 (best shown in FIG. 2) filled with particulate matter 20 is provided. Referring now to FIG. 1, the cavity 20 is defined between two filter plugs 22, such as are traditionally used in making cellulose acetate filters. The particulate matter 20 is preferably activated charcoal 24 but may be any other suitable active or inactive component, including sepiolite, silica gel, and nonactivated carbon. These particulate matter 20 can also include aromatic particulate.

The apparatus 10 capable of carrying out the process 12 is substantially that as shown in U.S. Pat. No. 4,223,597 (the content of which is incorporated by reference), wherein the process of filling, the filling part 12 of the '597 patent, and the receiving fixturing are improved.

Figure 2:
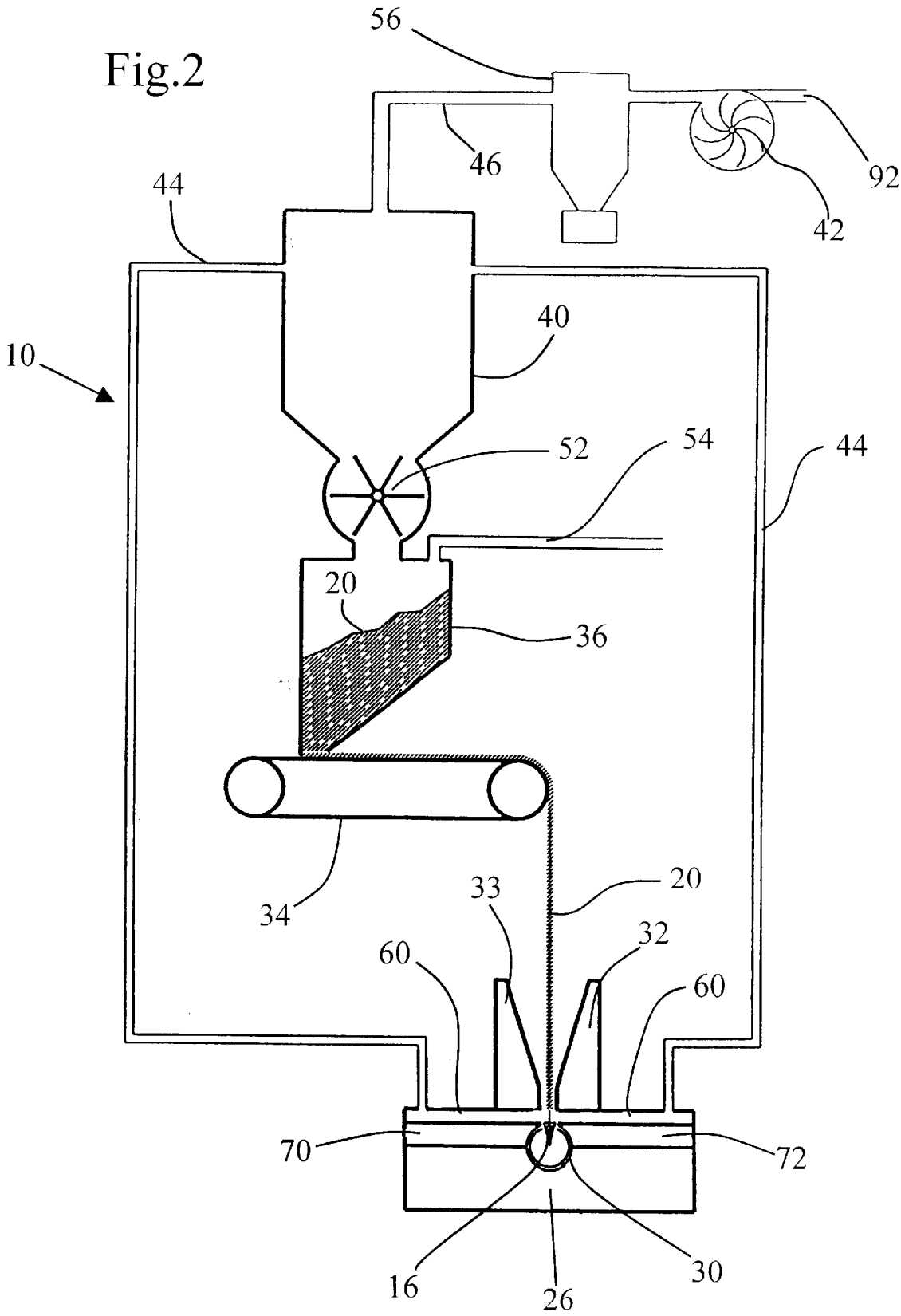
FIG. 2 is a schematic diagram of an apparatus capable of practicing the invention.

Referring now to FIG. 2, the apparatus 10 is shown in more detail. The apparatus 10 includes a garniture or tool body 26, a strip conveyor 30, a funnel 32, a conveyor 34, a hopper 36 containing solid material 20, a separator chamber 40, and a vacuum power unit 42, connected together as described below with associated vacuum lines (e.g., 44, 46) and other connections.

In operation, a vacuum power unit 42 creates a vacuum in the separator chamber 40 by expelling air through exit port 92. The cyclone separator and filter 56 filters dust from the air in which particulate material 20 is suspended, having been sucked through the vacuum lines 44 from the filling assembly 64. This vacuum action evacuates any particulate that may be loose within the filling assembly 64, via evacuation slits 60 disposed on either side of the opening 62 to the cavities 16. Particulate material 20 in the air falls to the bottom of the separation chamber 40 and finds its way into the hopper 36, through the sealed rotary air lock 52. The rotary air lock 52 allows the separator chamber 40 and the hopper 36 to have substantially differing pressures in which the hopper's pressure is substantially ambient. A feed line 54 provides the hopper with additional solid material 20 as needed. The hopper 36 deposits particulate matter 20 on the conveyor belt 34. The conveyor belt 34 conveys the solid material 20 from the hopper 36 to an area above the funnel 32 and then, into the funnel 32. The funnel-shaped entry 33 of the funnel 32, having a wide opening gradually narrowing along the direction of flow provokes acceleration of the particulate matter 20.

Figure 3A:
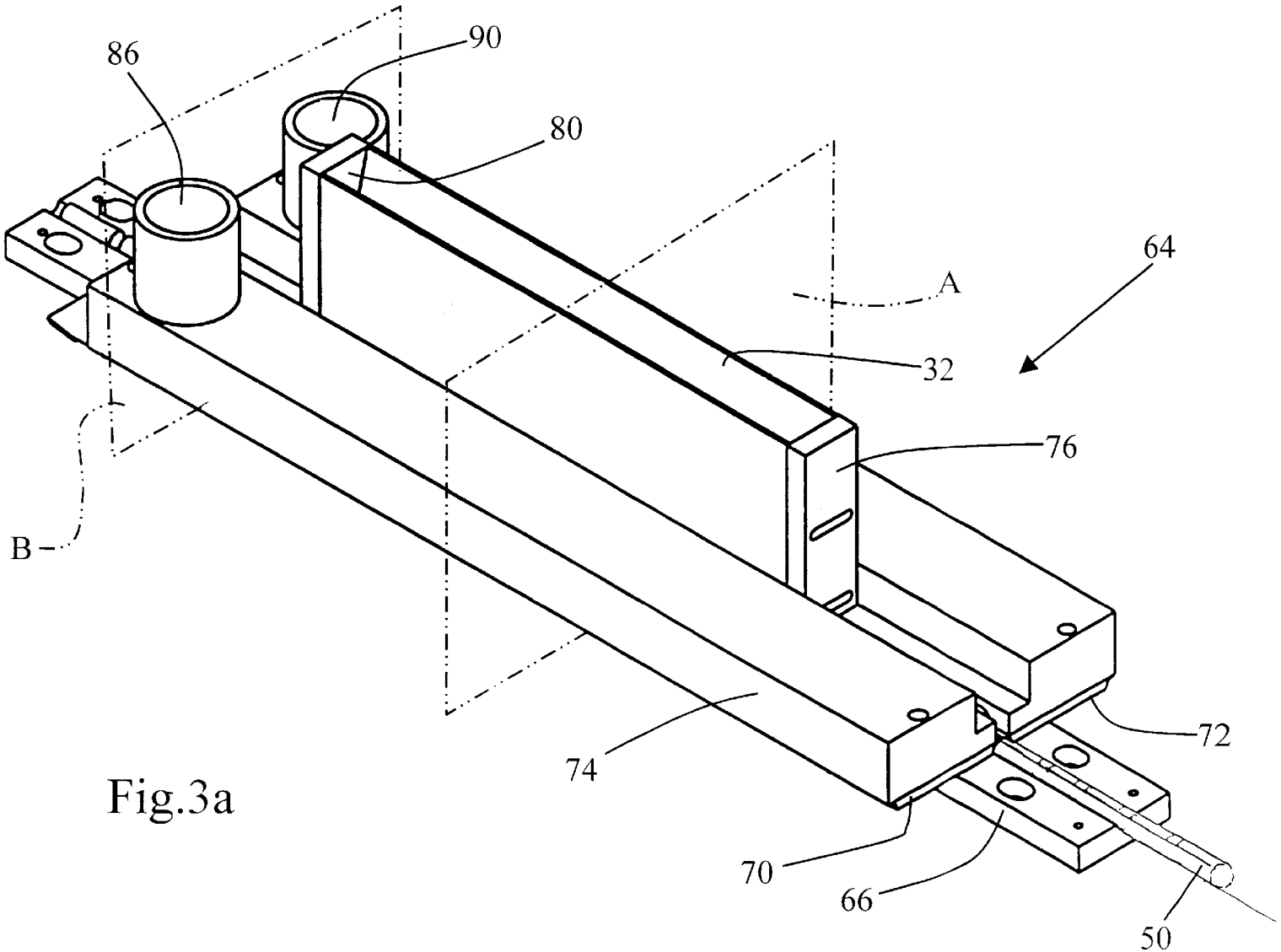
FIG. 3*a* is a perspective view of a particulate matter filling assembly of the invention.
Figure 3B:
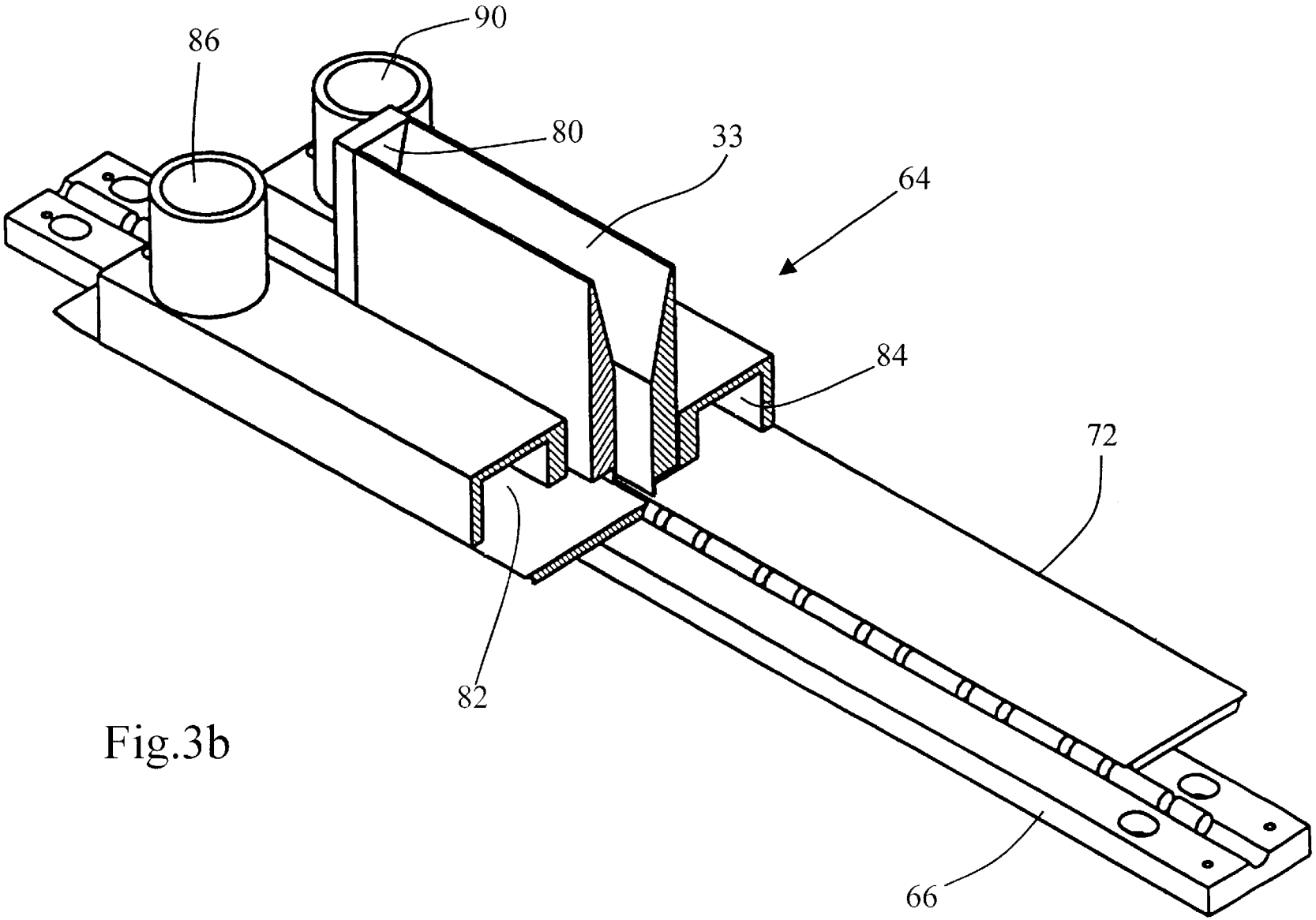
FIG. 3*b* is a perspective, staggered cross-sectional view of the particulate matter filling assembly, taken substantially along plane A of FIG. 3*a*.
Figure 3C:
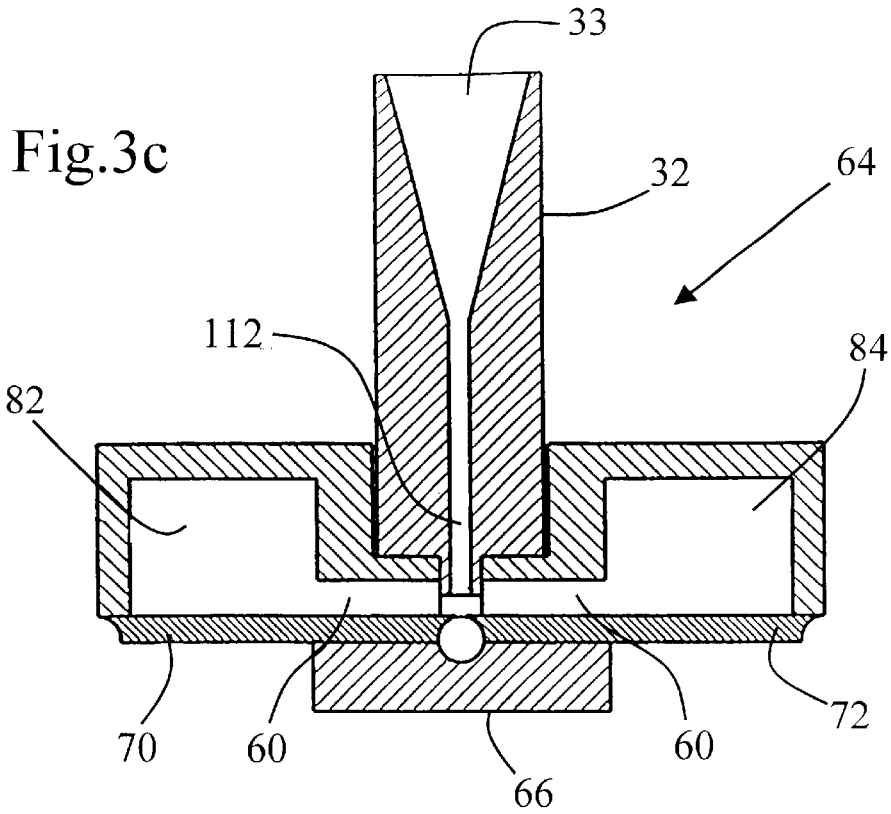
FIG. 3*c* is a front view of the cross-section of FIG. 3*b*.
Figure 3D:
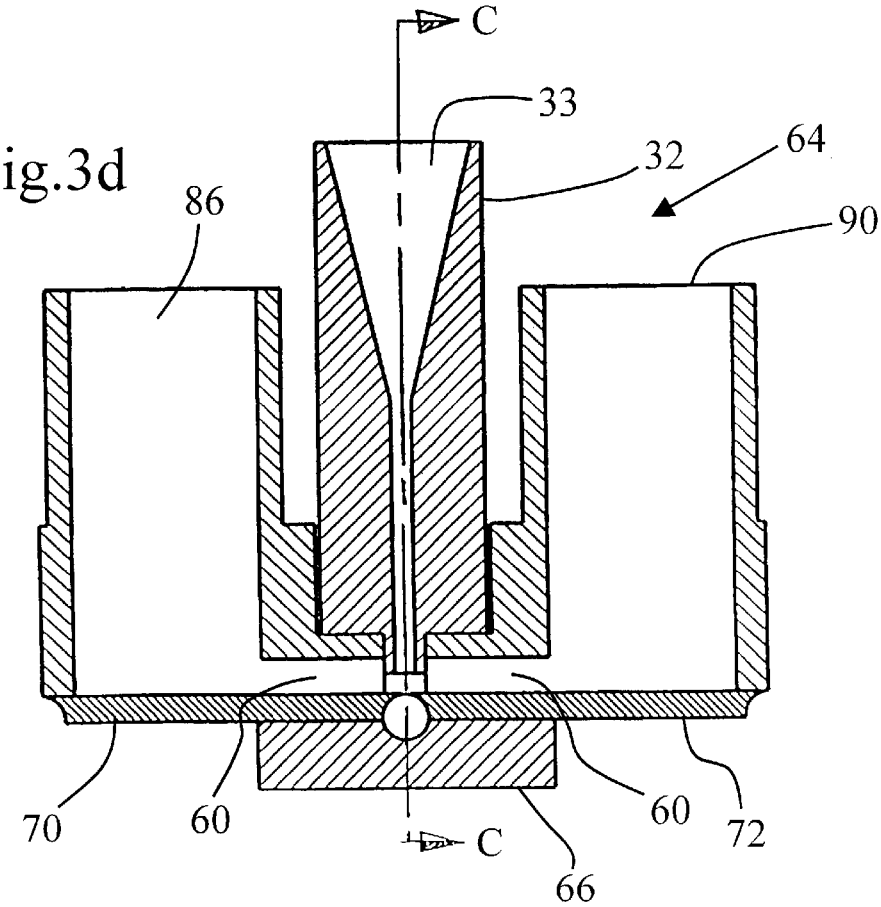
FIG. 3*d* is a front view of a cross-sectional view of the particulate matter filling assembly, taken along plane B of FIG. 3*a*.
Figure 3E:
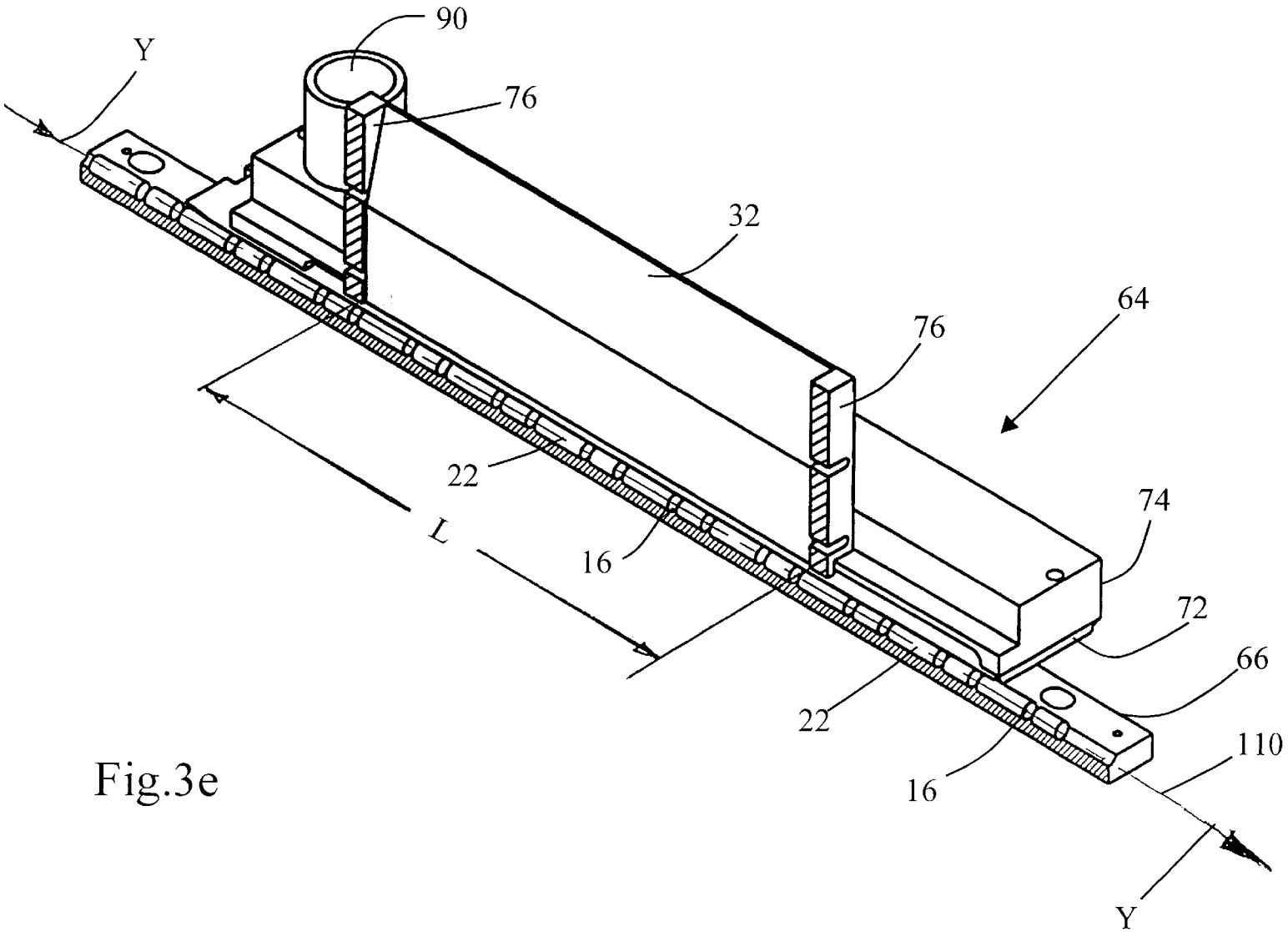
FIG. 3*e* is a perspective, cross-sectional view of the assembly of FIG. 3*a*, taken along plane C, shown in FIG. 3*d*.

The garniture 26 and strip conveyor 30 guide and position the strip 50 (shown in FIG. 3*a*) in the filling assembly 64. The funnel 32 directs solid material 20 into the cavities 16. The solid material 20 is gravity fed from the conveyer belt 34 with, to a limited extent, vacuum assistance (via evacuation slits 60).

Referring now to FIGS. 3*a*–3*e,* the filling assembly 64 of the apparatus 10 is shown. For clarity, cross-sections A and B are taken transverse to the line of motion and cross-section C is taken along the line of motion of the filter assembly 14.

The filling assembly 64 includes a lower garniture 66 and an upper garniture having a left portion 70 and a right portion 72. A manifold 74 covers the garniture 26 and provides a mounting for the funnel 32, which has two end caps 76 and 80. The manifold 74 defines vacuum passageways including the evaluation slit 60, channels 82 and 84, and exit ports 86 and 90. The exit ports 86 and 90 connect to vacuum lines 44. The vacuum helps draw the particles 20 into each cavity 16 while at the same time sucking away particles that fall to either side of the opening 62 and on the exposed portion of the filter segment 22.

Figure 4:
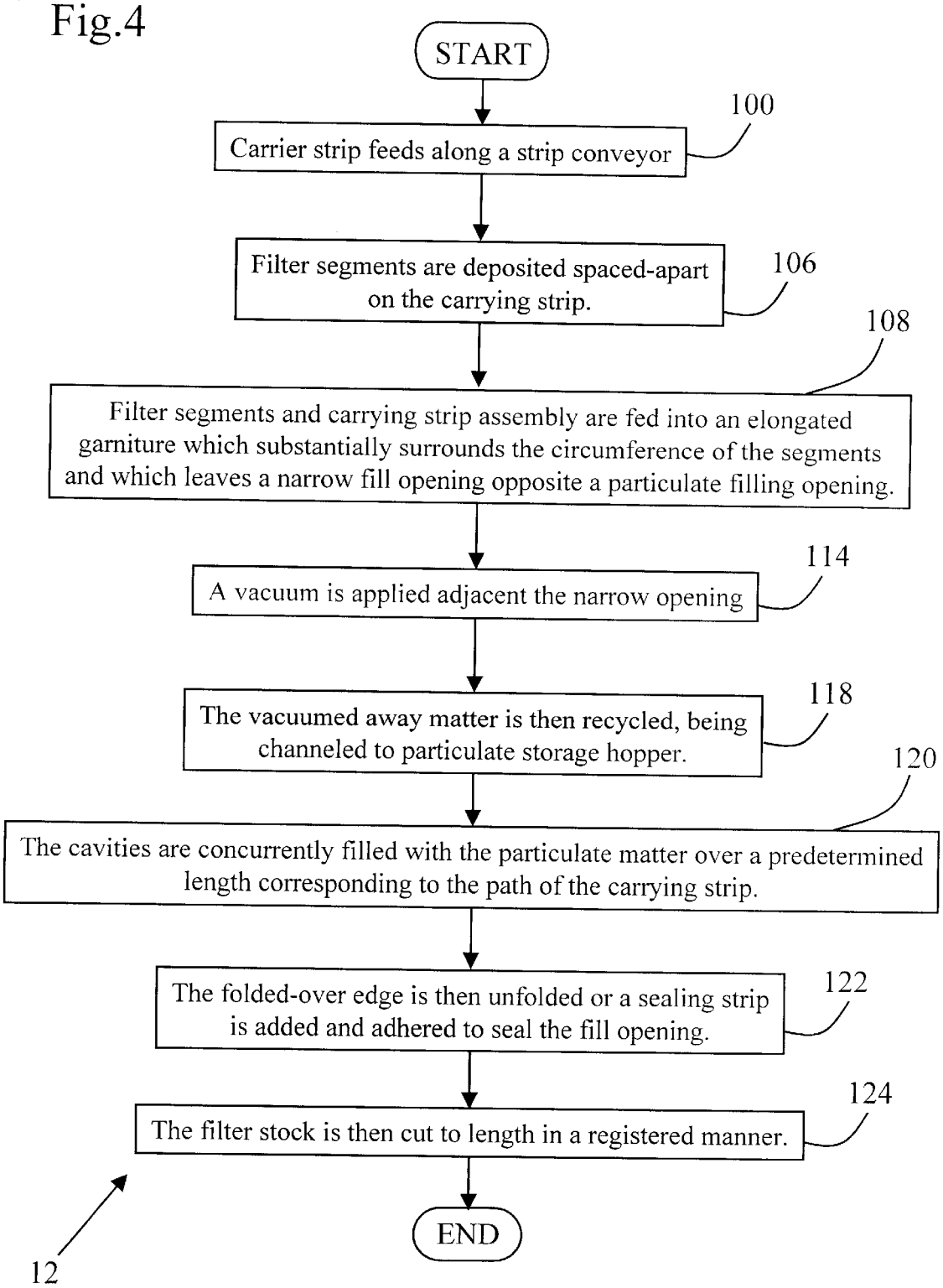
FIG. 4 is a flow chart of the process of the invention.

Referring now to FIG. 4, the process 12 includes several steps. In a first step 100, a paper ribbon or carrier strip 50 feeds along the strip conveyor 30. Along one edge 102 of the carrier strip 50, the paper is folded back against itself, forming a fold 104. In a second step 106, fibrous filter segments 22 are deposited on the carrying strip 50 in spaced apart intervals. The spacing between filter segments 22 defines cavities 16 between adjacent filter segments. In a third step 108, the carrier strip 50 together with the deposited filter segments 22 are fed along a path 110 of travel into the garniture 26 which substantially surrounds the circumference of the segments 22 and which leaves a narrow fill opening 62, generally between 2 and 3 mm in width, opposite a particulate filling opening 112. The filling opening 112 is elongated along the direction of motion 110, indicated by arrow Y in FIG. 3*e,* of the carrying strip 50.

In a fourth step 114, suction or a vacuum is concurrently applied to the evacuation slits 60 on opposite sides adjacent the narrow opening 62, the suction, thus increasing a downward momentum of a gravity fed, vacuum-assisted stream of particulate matter 20 and vacuuming away loose particulate matter 20 (also known as overflow matter). This also helps prevent particles 20 from becoming laminated between an overlap area 116 (on which the fold 104 will adhere) and the fold when the fold 104 is brought back across the narrow opening 62 to seal the opening. Such trapped particulate matter 20 is considered a product defect and is reason to reject a production run. In a fifth optional step 118, the vacuumed away matter is then recycled, being repressurized as it passes through the airlock 52 after which it is deposited in the hopper 36. Thus, such defects are to be avoided.

In a sixth step 120, the cavities 16 are concurrently filled with the particulate matter 20 over a predetermined length L (shown in FIG. 3*e*) corresponding to the path 110 of travel of the carrying strip 50. In a seventh step 122, the folded-over edge 104 is then unfolded and adhered to seal the fill opening 62. Alternately, a sealing strip as described in U.S. Pat. No. 4,225,597 seals the opening 62, thus encapsulating the filter segments 22 and particulate matter 20, creating a filter stock that exits the garniture 26. In an eighth step 124, the filter stock is then cut to length, the cutting being registered so as to cut through the filter segments 22, thus creating discrete composite filter segments which may be assembled together with a paper and tobacco to form a cigarette.

Experimentation has shown that, using the process 12 and apparatus 10 of the invention, the fill percentage remains directly proportional to the flow rate of particulate matter, up to a fill percentage of 95%. Thus, the process 12 permits the easy and accurate adjustment of the fill percentage to the demands of a customer.

In an alternate embodiment of the invention, the particulate matter 20 is made up of active matter (active charcoal 24) and inactive matter (e.g., an inert filler 25). The granulate shape, whether for active or inactive particulate matter, is very important as this characteristic affects the speed at which it can be accelerated toward the narrow opening of the cavity. In this manner, the amount of charcoal 24 in the filter can be varied and optimized, based on experimentation. Further, the affect that the active matter 24 has on the taste and the filtering properties of the cigarette can be controlled as well. Controlling the amount of active charcoal 24 in this manner (by adding filler) is necessary because it is not possible to reduce the size of the cavity 16, due to the variation in length of the opening 62 between filter elements 22 (i.e., the speed of the overall assembly operation is such that the filter elements 22 cannot be spaced apart on the carrier strip 50 very accurately and thus vary from an ideal relative position by as much as 0.5 mm in either direction). Further, active charcoal 24, the most widely used and available active filler, is only available in a single state. The charcoal 24 cannot be ordered at an economical price in a state that is 50% active, for example. Still further, the percentage of active vs. inactive matter can be precisely controlled by pre-mixing the active and inactive matter prior to placing the mixture in the particulate hopper 40 of the apparatus 10.

In an advantage of the invention, it is possible to fill 250 m/min. or five times faster than any competitive process that fully fills the cavity.

In another advantage of the invention, it is now possible, as a function of the feed rate and length of the elongated filling opening, to completely fill filter cavities (up to 100% filled is possible).

Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

What is claimed is:

1. A process of manufacturing composite filter stock comprising the steps of:

a). depositing fibrous filter segments on a carrying strip in a spaced apart relationship, thus defining cavities between adjacent filter segments;

b). feeding the carrying strip with the deposited filter segments along a path of travel into an elongated support chamber which substantially surrounds the circumference of the filter segment-retaining carrier strip and which leaves a narrow fill opening opposite a particulate filling opening of a filling assembly, the narrow fill opening being elongated along the direction of motion of the carrying strip;

c). concurrently applying a vacuum or suction adjacent the narrow opening, the vacuum or suction thus increasing a downward momentum of a gravity feed stream of particulate matter and vacuuming away loose particulate matter;

d). concurrently filling the cavities with the particulate matter over a length corresponding to a predetermined path of travel of the carrying strip; and f). applying a sealing portion which encapsulates the filter segments and particulate matter.

2. The process of claim 1 wherein suction is applied with two suction inlets, each disposed along opposite edges of the narrow opening.

3. The process of claim 1 wherein the particulate matter is a mixture of active and inactive components.

4. The process of claim 1 wherein the particulate matter includes aromatic particulate.

5. The process of claim 1, wherein the vacuumed away particulate matter is recycled.

6. The process of claim 1, wherein the filter stock is cut to length through the filter segments in order to create discrete composite filter segments.

7. The process of claim 1 wherein the filling assembly includes a funnel-shaped opening directed toward oncoming particulate matter flow, thus helping direct and accelerate the particulate matter into the cavities.

8. The process of claim 1 wherein the narrow fill opening is between 2 and 3 mm in width.

9. A filter product fabricated at high speed, the product having a cavity that is substantially completely filled with particulate matter, wherein the product is made by the process of any one of claims 1 to 8.

* * * * *